US007926205B2

(12) United States Patent
Åmark

(10) Patent No.: US 7,926,205 B2
(45) Date of Patent: Apr. 19, 2011

(54) SOLE ARRANGEMENT AND SHOE

(75) Inventor: Mikael Åmark, Brottby (SE)

(73) Assignee: Grip Force Technologies AB (SE)

( * ) Notice: Subject to any disclaimer, the term of this patent is extended or adjusted under 35 U.S.C. 154(b) by 442 days.

(21) Appl. No.: 12/063,376

(22) PCT Filed: Sep. 30, 2005

(86) PCT No.: PCT/SE2005/001448

§ 371 (c)(1),
(2), (4) Date: Feb. 8, 2008

(87) PCT Pub. No.: WO2007/037731

PCT Pub. Date: Apr. 5, 2007

(65) Prior Publication Data

US 2008/0271341 A1 Nov. 6, 2008

(51) Int. Cl.
*A43B 5/00* (2006.01)
*A43C 15/00* (2006.01)

(52) U.S. Cl. ..... 36/61; 36/134; 36/127

(58) Field of Classification Search ..... 36/61, 134, 36/62, 67 A–67 D, 67 R, 59 B, 131, 59 R, 36/127

See application file for complete search history.

(56) References Cited

U.S. PATENT DOCUMENTS 3,693,271 A * 9/1972 Korpei ..... 36/61
3,717,238 A * 2/1973 Fox ..... 36/61
3,793,751 A * 2/1974 Gordos ..... 36/61
4,825,562 A 5/1989 Chuang
4,873,774 A 10/1989 Lafever
5,299,369 A 4/1994 Goldman
5,337,494 A * 8/1994 Ricker ..... 36/61
5,526,589 A * 6/1996 Jordan ..... 36/134
5,732,482 A * 3/1998 Remington et al. ..... 36/61
5,737,855 A 4/1998 Jordan et al.
5,740,619 A * 4/1998 Broder ..... 36/61

(Continued)

FOREIGN PATENT DOCUMENTS

SE 524692 9/2004

OTHER PUBLICATIONS

PCT Application No. PCT/SE2005/001448, International Search Report mailed Apr. 28, 2006, 3 pgs.

(Continued)

*Primary Examiner* — Jila M Mohandesi
*Assistant Examiner* — Melissa L Lalli
(74) *Attorney, Agent, or Firm* — Schwegman, Lundberg & Woessner, P.A.

(57) ABSTRACT

The invention concerns a sole arrangement and a shoe comprising such a sole arrangement. The sole arrangement is characterized in that it comprises an upper sole member and a lower sole member wherein the lower sole member is positioned closer to the ground during normal use of the sole arrangement, said lower sole member being movably attached to the upper sole member allowing the lower sole member to move in a vertical direction relative to the upper sole member, a plurality of vertically extending spikes arranged inside the sole arrangement such that the spikes are moveable relative to the lower sole member, said lower sole member having a plurality of holes adapted to receive the spikes as to allow the spikes to protrude from the lower sole member in a downward direction, and a locking sole member located between the upper and lower sole members.

22 Claims, 8 Drawing Sheets

U.S. PATENT DOCUMENTS

| | | | | |
|---|---|---|---|---|
| 5,946,828 | A * | 9/1999 | Jordan et al. | 36/61 |
| 6,058,627 | A | 5/2000 | Violette et al. | |
| 6,125,556 | A | 10/2000 | Peckler et al. | |
| 6,256,907 | B1 * | 7/2001 | Jordan et al. | 36/61 |
| 6,389,714 | B1 * | 5/2002 | Mack | 36/61 |

OTHER PUBLICATIONS

PCT Application No. PCT/SE2005/001448, Written Opinion mailed Apr. 28, 2006, 4 pgs.

* cited by examiner

SOLE ARRANGEMENT AND SHOE

RELATED APPLICATION

This application is a nationalization under 35 U.S.C. 371 of PCT/SE2005/001448, filed Sep. 30, 2005 and published as WO 2007/037731 A1 on Apr. 5, 2007, which application and publication are incorporated herein by reference and made a part hereof.

TECHNICAL FIELD

The invention relates to shoes with retractable spikes.

BACKGROUND ART

Shoes equipped with spikes are used for getting a good grip on slippery surfaces. Typically, spiked shoes are useful for people walking on streets or pavements covered with snow and ice and for golfers. Conventional spiked shoes suffer from the drawback that the spikes are in constant contact with ground surface during wear, also in situations where spikes are not necessary, such as on hard surfaces, or where spikes are unsuitable, such as on most indoor floors. This causes excessive wear on the spikes and certain surfaces or makes a frequent switching of shoes necessary.

To overcome these disadvantages various examples of shoes with retractable spikes has been proposed over the years. U.S. Pat. No. 4,873,774 discloses one example where a fluid pressure is used to push cleats to extend from the sole bottom. Another example is disclosed in U.S. Pat. No. 5,299,369 where pneumatically actuated, rotatable spikes are used. Still another example is disclosed in U.S. Pat. No. 6,058,627 where spikes are slidable between a retracted and an extended position. Still another example is disclosed in U.S. Pat. No. 6,125,556 where high pressure liquid is used to extend the spikes. None of the various examples of shoes with retractable spikes appears to have been any success; possibly because of a too complex structure, a too low structural strength or of functioning problems when exposed to dirt. SE524692 discloses another approach where hydraulic lifting pads placed under the outer sole are arranged to expand such that spikes mounted to the outer sole loose contact with the ground. Also this construction is relatively complex involving hydraulic conduits and controlling devices.

DISCLOSURE OF INVENTION

An object of this invention is to provide a shoe and sole arrangement with retractable spikes that is less complex and more reliable than previously known shoes with retractable spikes. This object is achieved by the technical features contained in claim 1 and 22. The dependent claims contain advantageous embodiments, further developments and variants of the invention.

The invention concerns a sole arrangement and is characterized in that it comprises an upper sole member and a lower sole member wherein the lower sole member is positioned closer to the ground during normal use of the sole arrangement, said lower sole member being movably attached to the upper sole member allowing the lower sole member to move in a vertical direction relative to the upper sole member, a plurality of vertically extending spikes arranged inside the sole arrangement such that the spikes are moveable relative to the lower sole member, said lower sole member having a plurality of holes adapted to receive the spikes as to allow the spikes to protrude from the lower sole member in a downward direction, a locking sole member located between the upper and lower sole members, a spacing means extending vertically from one of said sole members, and an opening arranged on another of said sole members, said opening being adapted to receive the spacing means, said spacing means and spacer-receiving opening being arranged to face each other as to allow interaction between the two sole members equipped with the spacing means and the spacer-receiving opening, respectively. The invention is further characterized in that said locking sole member is movably arranged as to allow a relative movement between the spacing means and the spacer-receiving opening in a substantially horizontal direction, said locking sole member being adapted to be moved between a first position wherein the spacing means and the spacer-receiving opening are at least partly displaced such that the spacing means defines a minimum distance between the two interacting sole members, and a second position wherein the spacing means and the spacer-receiving opening are aligned in such a way that the spacer-receiving opening is capable of receiving the spacing means allowing the two interacting sole members to come closer to each other than the minimum distance.

In other words, the invention concerns a spike-equipped sole arrangement wherein the distance between the lower sole member and the upper parts of the sole arrangement can be varied such that the spikes are allowed to project out from the lower sole member to a varying extent. The inventive design of the locking member, the spacing means and the spacer-receiving opening has the advantageous effect that by moving the locking sole member between its first and second positions the lower sole member can be set in a locked "spike-retracting" mode, wherein the spikes are recessed within the sole arrangement, and a "spike-extending" mode, wherein the spikes are allowed to protrude below the lower sole member. The inventive locking mechanism is very efficient and due to its robust structure it is very reliable. An important advantage of the invention compared to prior art is that the weight of the user is carried by the locking sole member and the spacing means, i.e. by a robust mechanical arrangement, when the shoe is in its spike-retracted mode.

In a first advantageous embodiment of the invention the lower sole member is attached to the upper sole member via a sole connecting means that surrounds the sole arrangement. Besides the main function of connecting the upper and lower sole members in such a way that the lower sole is allowed to move in a vertical direction relative to the upper sole and the spikes, the sole connecting means has the main function of preventing dirt from entering the sole arrangement.

In a second advantageous embodiment of the invention the spacing means is located between the locking sole member and the lower sole member. Preferably, the spacing means is associated with the lower sole member and the spacer-receiving opening associated with the locking sole member. Preferably, the spacing means forms an integral part of the lower sole member and constitutes a plurality of protrusions extending upwardly from the lower sole member.

In a third advantageous embodiment of the invention the locking sole member is provided with a hole forming said spacer-receiving opening.

In a fourth advantageous embodiment of the invention the sole arrangement comprises extending means located between the two interacting sole members, said extending means being capable of exerting a force between the two interacting sole members as to allow a variation of their relative distance. An advantageous effect of this design is that the interacting sole members can be forced apart so that the spacing means are released from their corresponding openings. This way it becomes easy to move the locking sole member horizontally between its two positions without being hindered by the spacing means. Preferably, the extending means are arranged between the lower sole member and the locking sole member. Preferably, the extending means comprises a coil spring. Such springs have the advantage that they have a low height/thickness in their compressed state which is helpful in trying to keep the total height of the sole arrangement 4 as low as possible.

The invention also concerns a shoe characterized in that it comprises a sole arrangement of the above type.

BRIEF DESCRIPTION OF DRAWINGS

In the description of the invention given below reference is made to the following figure(s), in which.

EMBODIMENT(S) OF THE INVENTION

Figure 1:
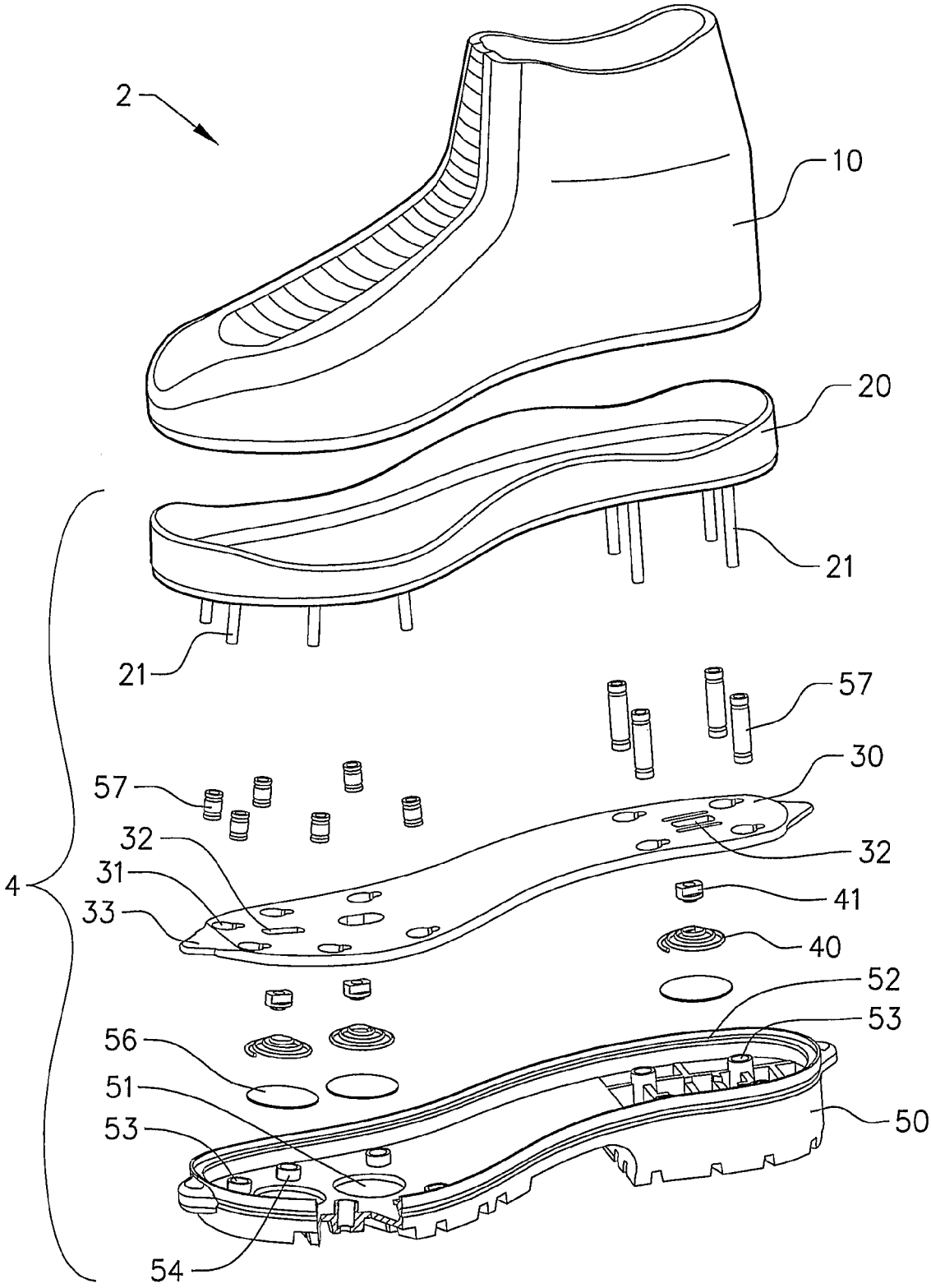
FIG. 1 shows, in an exploded perspective view, a first advantageous embodiment of the invention.
Figure 2:
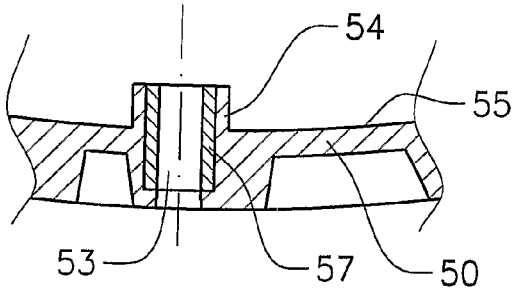
FIG. 2 shows, in an enlarged view, a first detail of the embodiment according to FIG. 1.
Figure 4:
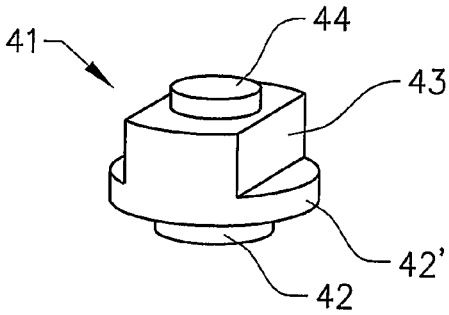
FIG. 4 shows, in an enlarged view, a third detail of the embodiment according to FIG. 1.
Figure 3:
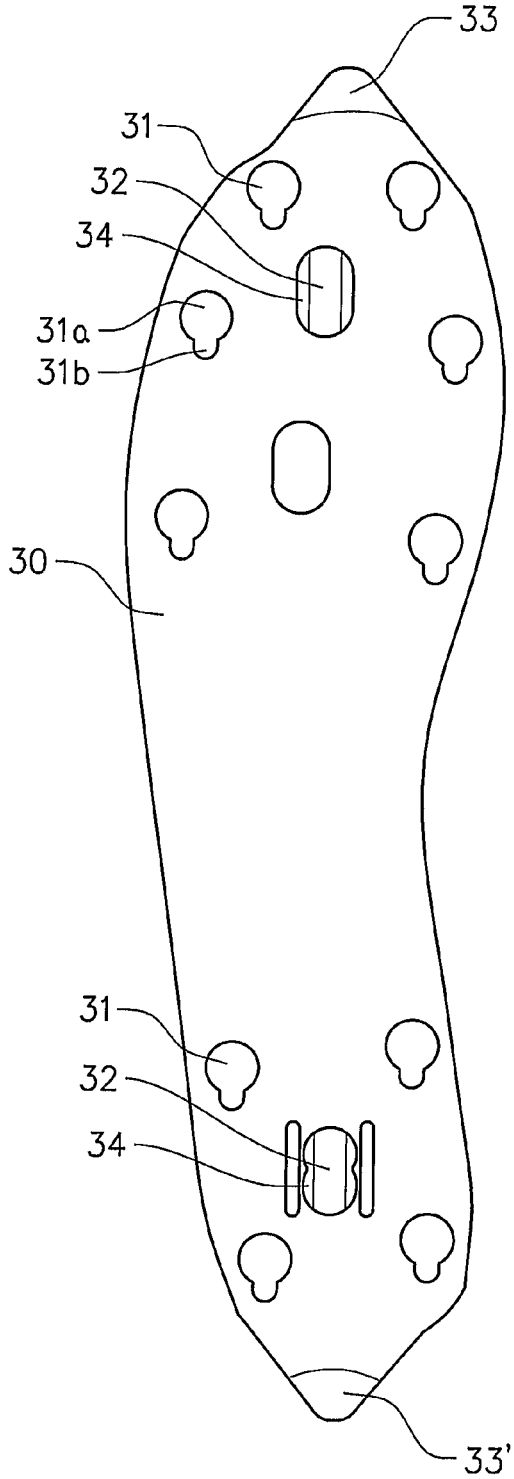
FIG. 3 shows a second detail of the embodiment according to FIG. 1.

FIG. 1 shows, in an exploded view, a first preferred embodiment of the invention. A shoe 2 is constituted of an upper part 10 and a sole arrangement 4. The sole arrangement 4 comprises an upper sole member 20 provided with a plurality of spikes 21 protruding in a downward direction, a locking sole member in the form of a locking plate 30, three conical coil springs 40 and a lower sole member 50 provided with a plurality of holes 53 adapted to receive the spikes 21. Plastic sleeves 57 are positioned in the holes 53 to reduce friction, increase sealing and remove dirt from the spikes 21. The upper and lower sole members 20, 50 are attached to each other via a bellows 52 allowing the lower sole member 50 to be moved in a vertical direction relative to the upper sole member 20, and thus relative to the spikes 21. As more clearly shown in FIG. 2, the lower sole 50 is provided with a spacing member in the form of a rim 54 around each of the spike-receiving holes 53 on the upper surface 55 of the lower sole 50. The rims 54 form an integrated part of the lower sole 50. In FIG. 3, showing the locking plate 30 as seen from below, it can be seen that the locking plate 30 is provided with a plurality of keyhole-shaped through holes 31. The wider part 31*a* of these keyhole-shaped holes 31 is adapted to receive one of the rims 54 of the lower sole 50 when the locking plate 30 is in a rear position in which position the spikes 21 are allowed to extend out from the lower sole 50. The narrow part 31*b* of the keyhole-shaped holes 31 is adapted to receive one of the spikes 21 when the locking plate 30 is in a forward, locked position where the spikes 21 are kept inside the sole arrangement 4. Actuators 33, 33', in the form of extensions of the locking plate 30, are positioned at the front and rear of the locking plate 30 allowing control of the movement of the locking plate 30 between the two positions. Further, the locking plate 30 is provided with rectangular openings 32 that allow the springs 40, via connecting members 41, to act directly between the lower sole 50 and the upper sole member 20. As can be seen in FIG. 3 first recesses 34 are arranged around two of the rectangular openings 32 on the underside of the locking plate 30 as to receive a part of the connecting member 41. The rear recess 34 has been given a more narrow middle part as to form a resistance towards unintentional movement of the locking plate 30 between its two positions. Each lower end of the conical coil springs 40 are arranged on supporting plates 56 in second recesses 51 in the lower sole 50. Each connecting member 41 connects the upper end of each spring 40 with the upper sole member 20. As shown in FIG. 4 the connecting member 41 has a first and second lower circular part 42, 42' adapted to fit in and onto the upper end of the springs 40, wherein the second lower circular part 42' is adapted to also fit into the first recesses 34. The main functions of the second lower part 42' are to hold up the locking plate 30 and to form said resistance towards unintentional movement of the locking plate 30. The connecting member 41 has further a rectangular mid-part 43 adapted to fit through the rectangular openings 32 of the locking plate 30 and an upper circular part 44 adapted to be received by openings (not shown) in the lower surface of the upper sole 20. The main function of the mid-part 43 is to guide the motion of the locking plate 30 whereas the main function of the upper part 44 is to keep the connecting member 41, and thus the locking plate 30, in place. When the shoe 2 or sole arrangement 4 is put together the conical coil springs will be at least partly compressed.

Figure 5:
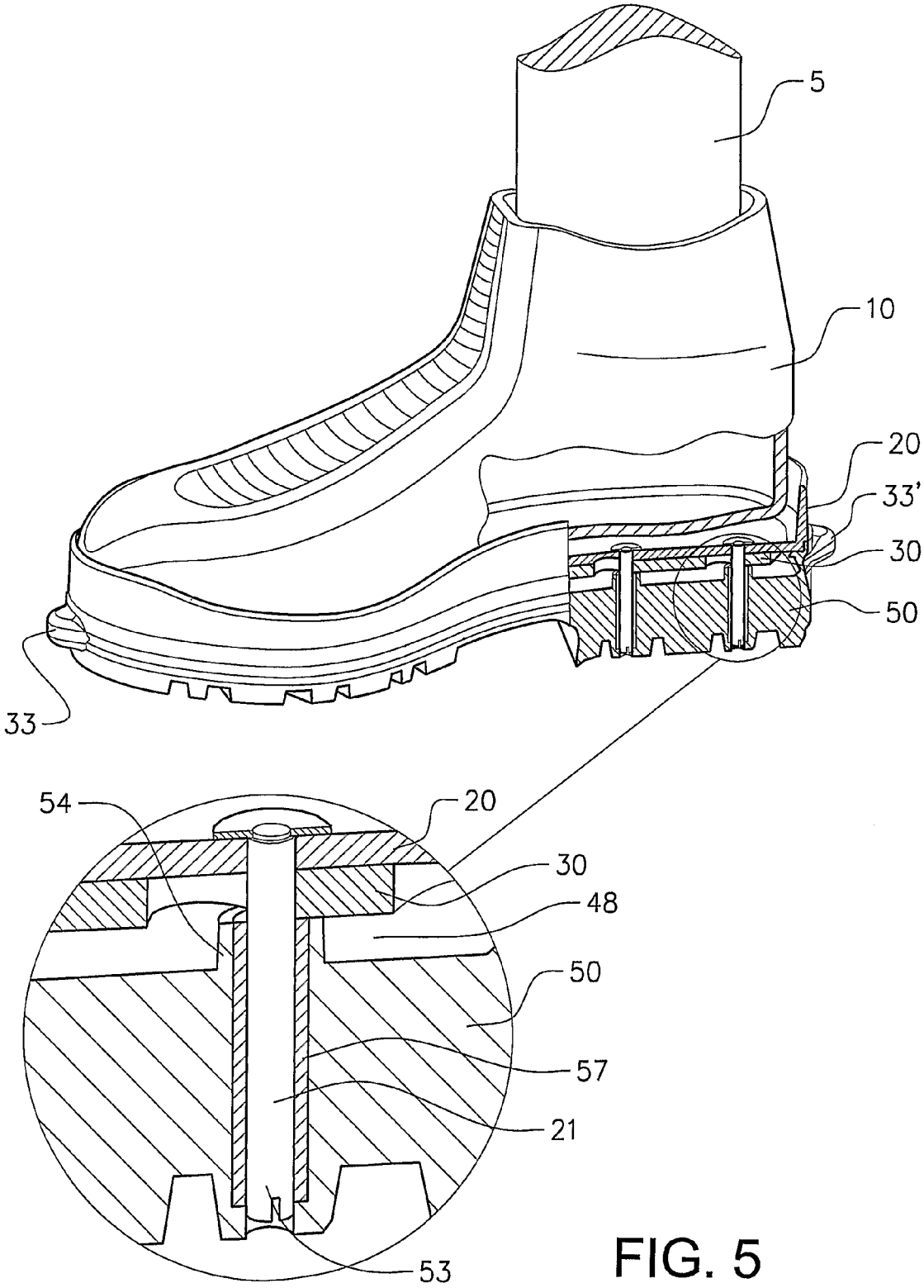
FIG. 5 shows the embodiment according to FIG. 1 in a first mode wherein the spikes are recessed within the shoe.
Figure 6:
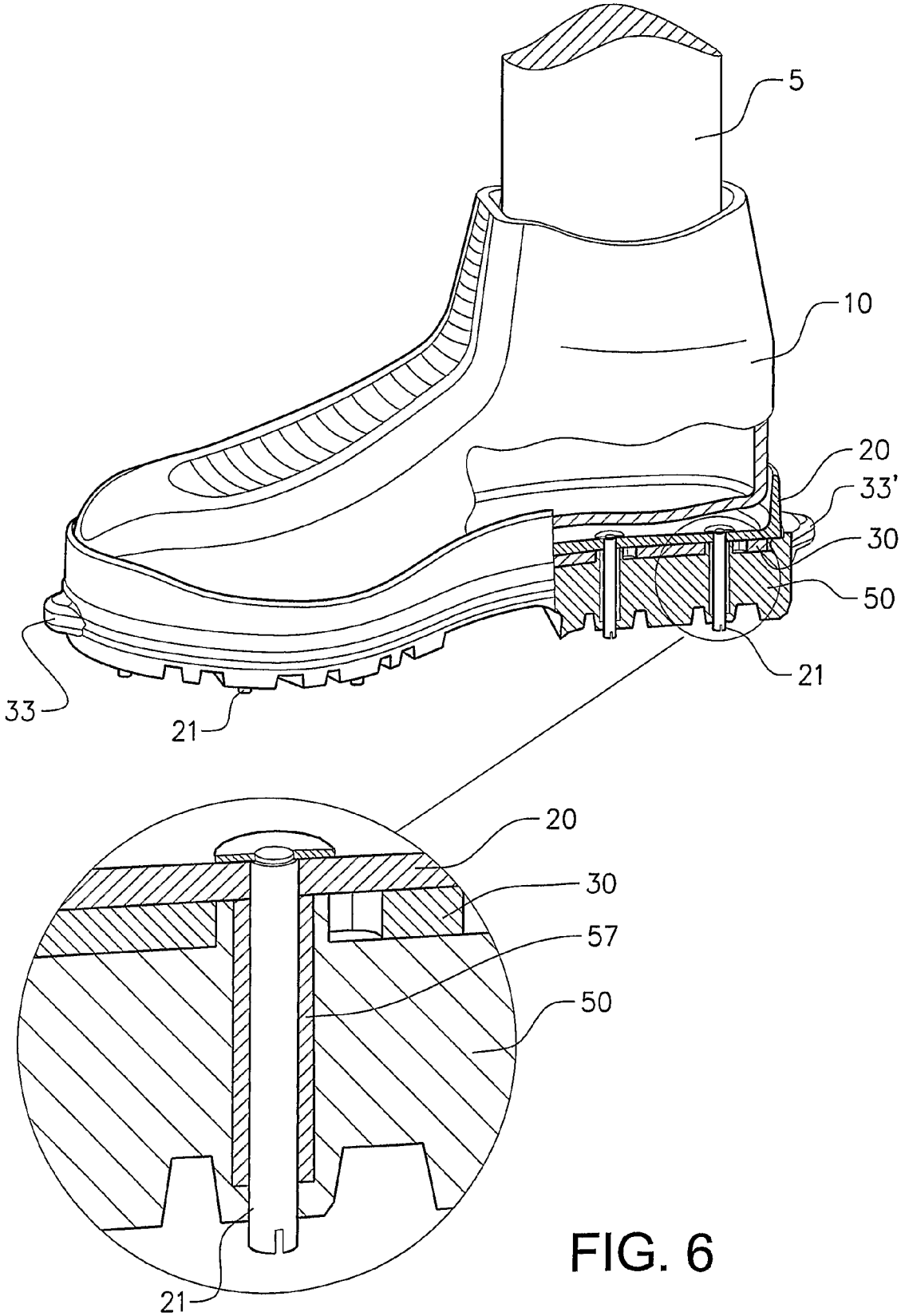
FIG. 6 shows the embodiment according to FIG. 1 in a second mode wherein the spikes extend out from the shoe.

The function of the sole arrangement 4 will now be described with reference to FIGS. 5 and 6, wherein FIG. 5 shows the shoe 2 in a first mode where the spikes 21 are prevented from being exposed outside the lower sole 50 by locking them inside the sole arrangement 4, and wherein FIG. 6 shows the shoe 2 in a second mode where the spikes 21 are allowed to extend out from the lower sole 50. Both FIGS. 5 and 6 show a magnified view of a partial cross section of the shoe 2.

In the spike-retracted mode shown in FIG. 5 the locking plate 30 is in its forward position with the spikes 21 passing through the narrow part 31*b* of the keyhole-shaped through holes 31. In this position lateral movement of the locking plate 30 is prevented by e.g. the spikes 21 that act against the walls of the keyhole-shaped hole 31 and by the connecting members 41 that act on the walls of both the first recesses 34 and the rectangular openings 32. Longitudinal movement of the locking plate 30 when in this position is prevented by the narrow middle part of the recess 34 that creates an increased resistance towards passing the second lower part 42' of the connecting member 41, but also by friction between the locking plate 30 and various internal parts of the sole arrangement 4. Vertical movement of the locking plate 30 in a downward direction is prevented by the rims 54 since the locking plate 30, when in its forward position, is located on top of the rims 54, i.e. the spacing means 54 and the spacer-receiving opening 31*a* are displaced relative to each other. As clearly shown in the magnified part of FIG. 5 a gap 48 is formed between the locking plate 30 and the lower sole 50. Because the upper sole member 20 is positioned on top of the locking plate 30 the rims 54 also prevent the upper sole member 20, and thus also the spikes associated with the upper sole member 30, from moving any further towards the lower sole 50. This way the spikes 21 can be locked in a certain retracted position. As seen from FIG. 5 the length of the spikes 21 has been adapted as to leave a small gap between the end of the spikes 21 and the underside of the lower sole 50 when the spikes 21 are in their locked and retracted position. An important advantage of the invention compared to prior art is that the weight of the user is carried by the locking plate 30 and the spacing means 54, i.e. by a robust mechanical arrangement, when the shoe is in its spike-retracted mode.

In FIG. 6 the locking plate 30 has been moved to its rear position by pushing the front actuator 33. The operation of the actuators 33, 33' is easily carried out by pressing or kicking the heel, or toe, part of the shoe 2 against the ground or a wall. When the front actuator 33 is pushed the whole locking plate 30 is moved longitudinally in a backward direction such that the wider part 31*a* of the keyhole-shaped holes 31 become aligned above the rims 54. Since this part of the holes 31 is adapted to the shape of the rims 54 the locking plate 30 is free to move downwards and rest directly on the upper surface 55 of the lower sole 50 eliminating the gap 48. This has the effect that also the upper sole member 20, and thus the spikes 21 associated with the upper sole member 20, is free to move downwards until it is stopped by the rims 54 and the locking plate 30 which have a similar height/thickness. The expanding forces of the springs 40, together with the forces of the bellows 52, keep the locking plate 30 and the upper sole member 20 with its spikes 21 in an upper position. The gravitational forces of a shoe user 5 will however overcome the expanding forces resulting in that the upper sole member 20, the spikes 21 and the locking plate 30 move downwards, in turn resulting in that the spikes 21 will protrude below the lower sole 50 as shown in FIG. 6. In FIG. 6 the spikes 21 are exposed to a maximum. The length of the exposed portion of the spikes 21 depends e.g. on the surface the user are standing or walking on; if the surface is very hard, such as stone, the spikes 21 protrude only to a small extent, or may even be flush with the underside of the outer sole 50. The spikes 21 will be automatically retracted to an unlocked position as soon as the shoes 2 are lifted or taken off due to the forces of the coil springs 40 and the bellows 52 that push the lower sole 50 away from the locking plate 30 and pushes the locking plate 30 into an upper unlocked position. To lock the spikes 21 inside the sole arrangement 4 one thus only need to lift the shoe 2 and push the rear actuator 33 by pressing or kicking the heel part of the shoe 2 against the ground or a wall. This will have the effect that the locking plate 30 is moved longitudinally in a forward direction to its front, locked position as shown in FIG. 5.

The rectangular mid-part 43 of the connecting member 41 has preferably a height that is slightly more than the height/thickness of the locking plate 30 as to form a small gap between the locking plate 30 and the upper sole member 20. This way the forces of the springs 40 can act directly onto the upper sole 20 via an upper side of the rectangular mid-part 43 of the connecting member 41. If instead the forces of the springs 40 would act only onto the locking plate 30 the locking plate 30 might be too difficult to slide between its two positions.

The first embodiment of the invention can be modified in various ways. For instance, the spacing means 54 may instead be attached to the locking sole member 30 with the spacer-receiving openings 31*a* located in the lower sole member 50. Alternatively, the spacing means 54 could be positioned between the upper sole member 20 and the locking sole member 30 with the spacing means 54 associated with one of these two sole members and the spacer-receiving openings 31*a* associated with the other. Further, other spacing means may be used as an alternative to the rims 54. Such alternative spacing means may differ in shape, number and position compared to the rims 54 described above. They may also be attached to the sole member by other means than forming an integral part of the sole member. As an example of such alternative spacing means one could glue a number of cubic members to the lower sole 50 at various positions. Of course, the spacer-receiving openings 31*a* of the locking plate 30 need to be adapted to the shape, number and position of the spacing means so that the locking plate 30 is allowed to be lowered towards the lower sole 50, i.e. so that the locking plate 30 fits between the spacing means. In the embodiment described above the spacing means, i.e. the rims 54, are positioned adjacent to the spike-receiving holes 53 which makes the use of key-hole shaped openings 31 advantageous. However, if the spacing means are not positioned adjacent to the spike-receiving holes 53 one may provide the locking plate 30 with a first type of openings adapted to receive only the spacing means and a second type of openings adapted to receive only the spikes 21 as well as to allow the locking plate 30 to be moved in a horizontal direction. Such second type of openings could simply be a hole with an elongated shape. The embodiment of the invention described above is, however, advantageous in that it allows for a reliable function and a cost-effective production.

Moreover, it is of course possible to vary the number of springs 40. Other types of springs can also be used but the conical coil springs 40 have the advantage that they have a low height/thickness in their compressed state which is helpful in trying to keep the total height of the sole arrangement 4 as low as possible. A main feature of the springs 40 are their capability to extend vertically as to force the sole members apart so that the rims 54 are released from their corresponding openings 31*a*. This way it becomes easy to move the locking plate 30 horizontally between its two positions without being hindered by the spacing means 54. As an alternative to springs 40 one may use other extending means such as a foam-based resilient material. One could also use other types of extending means such as an inflatable bladder, a hydraulic arrangement or a wedge-shaped mechanical arrangement. The latter types of extending means could be adapted to extend vertically only upon activation and could be combined with a function for locking the sole arrangement 4 with the spikes projecting out below the lower sole member 50.

Figure 7:
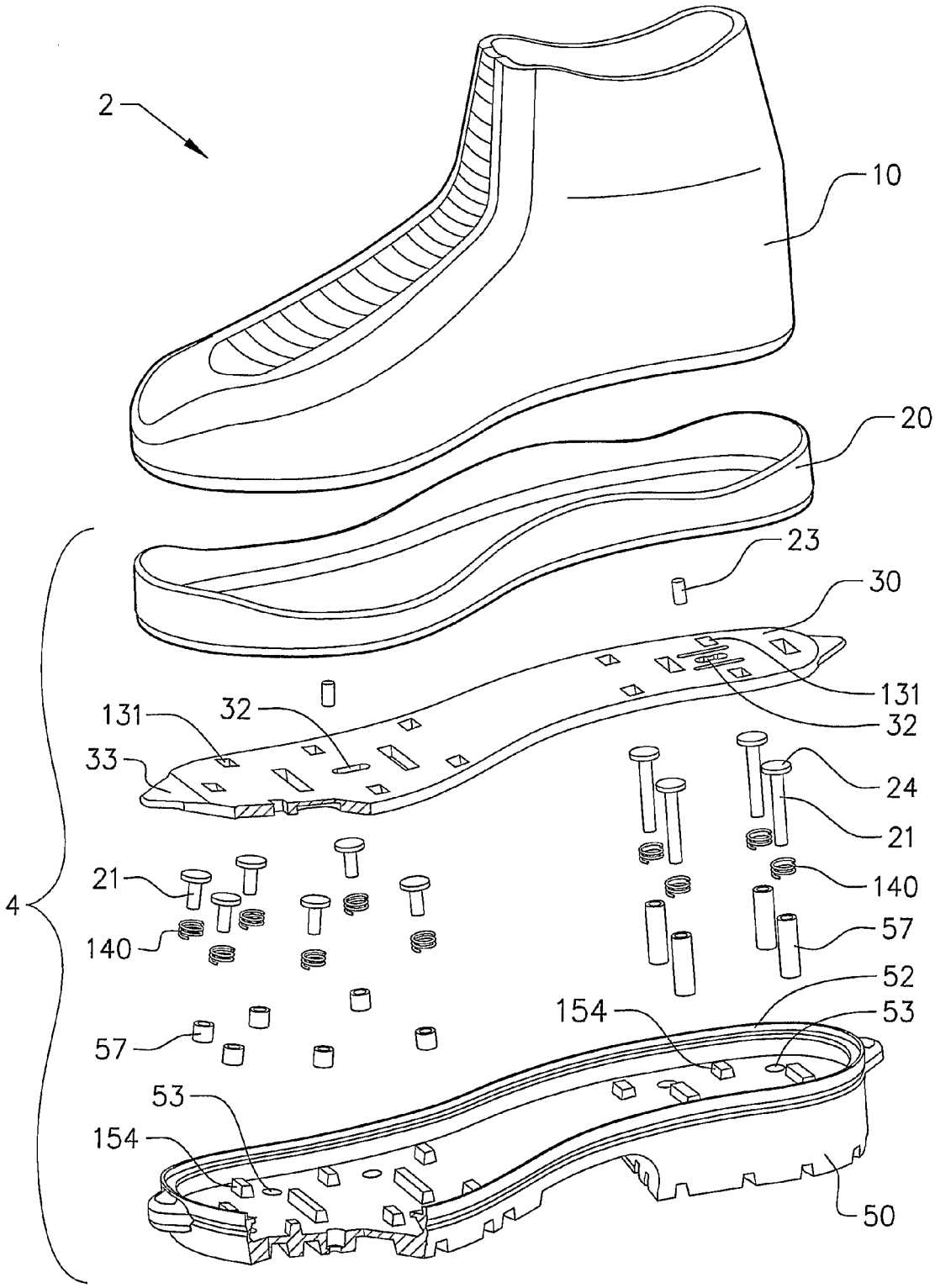
FIG. 7 shows, in an exploded perspective view, a second advantageous embodiment of the invention.
Figure 8:
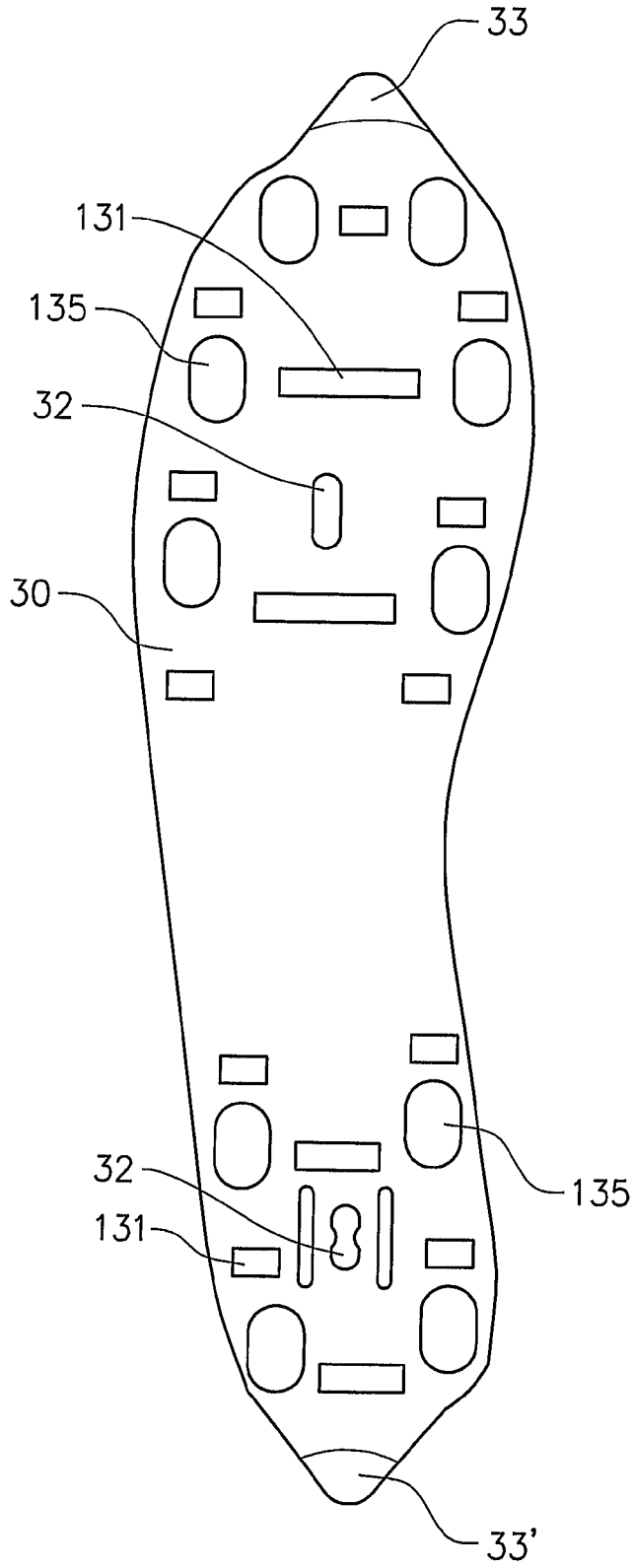
FIG. 8 shows a detail of the embodiment according to FIG. 7.

FIGS. 7-10 show a second embodiment of the invention. As can be seen in FIG. 7 one difference compared to the first embodiment is that the spikes 21 are arranged in an alternative way. Another difference is that the spacing means 154 and the spacer-receiving openings 131 are designed in an alternative way. Still another difference is that the upper sole member 20 is provided with guiding pins 23 adapted to fit in the guiding openings 32 for guiding the movement of the locking plate 30. The rear guiding opening 32 has a more narrow mid-part as to avoid unintentional movement of the locking plate 30. In the second embodiment of the invention the spikes 21 are arranged between the lower sole member 50 and the locking sole member 30. Each spike 21 is provided with a cap 24 and below this cap 24 a conical coil spring 140 is arranged around the spike 21 such that the spring 140 acts between the underside of the cap 24 and the upper side of the lower sole member 50. This has the effect that the spring 140 continuously presses the spike 21 upwardly towards the underside of the locking member 30. As can be seen in FIG. 8 the locking plate 30 is provided with recesses 135 adapted to receive the spike cap 24. Together with the hole 53 that encloses the lower part of the spike 21 the spring 140 thus holds each spike 21 in place in an efficient manner. The cap 24 could form an integral part of the spike 21 or could be attached to the spike 21 by welding or any other suitable fastening means. The spacing means 154, having the shape of rectangular blocks, extend vertically from the upper side of the lower sole member 50. The upper part of these blocks 154 are more narrow than the base as to ensure a reliable interaction with the spacer-receiving openings 131 which have a corresponding shape. The rims around the spike-receiving holes 53 do not act as spacing means in the second embodiment exemplified in FIGS. 7-10. Nevertheless, the presence of such rims may be advantageous since they may be used to stabilize and guide the spikes 21. The rims, and also the plastic sleeves 57, are preferably made with a somewhat decreased height in this second embodiment as to avoid interference with the retracting-extending function of the sole arrangement 4. FIG. 8 shows the cap-receiving recesses 135 that extend in the longitudinal direction of the locking plate 30 as to allow the cap 24 to fit regardless of the position of the locking plate 30. FIG. 8 also shows the spacer-receiving openings 131 which are positioned and shaped as to correspond with the spacing means 154.

Figure 9:
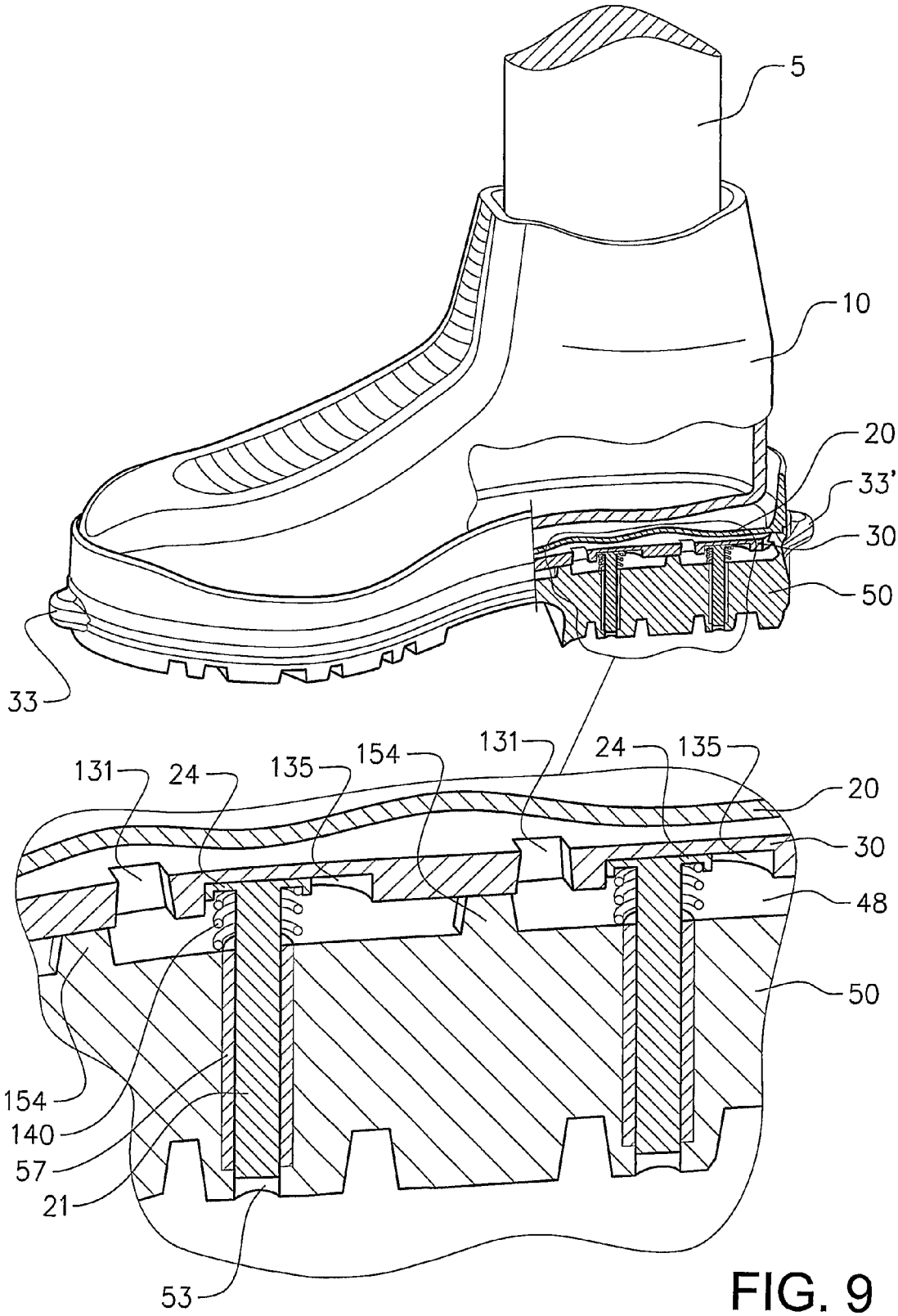
FIG. 9 shows the embodiment according to FIG. 7 in a first mode wherein the spikes are recessed within the shoe.
Figure 10:
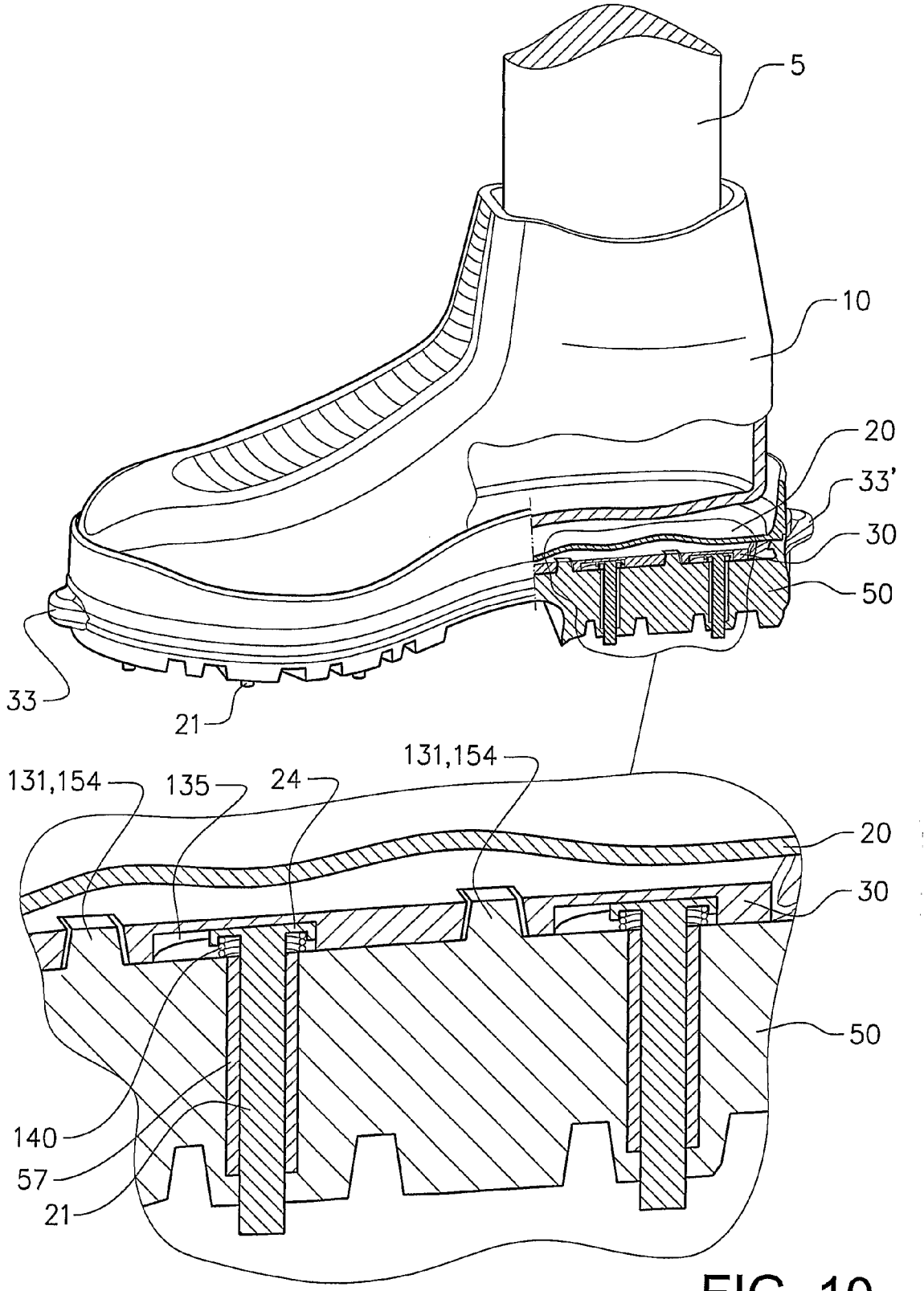
FIG. 10 shows the embodiment according to FIG. 7 in a second mode wherein the spikes extend out from the shoe.

The function of the sole arrangement 4 according to the second embodiment is in most parts similar to what is described in connection to the first embodiment. FIG. 9 shows the shoe 2 in a first mode where the spikes 21 are prevented from being exposed outside the lower sole 50 by locking them inside the sole arrangement 4, and FIG. 10 shows the shoe 2 in a second mode where the spikes 21 are allowed to extend out from the lower sole 50. Both FIGS. 9 and 10 show a magnified view of a partial cross section of the shoe 2. In the spike-retracted mode shown in FIG. 9 vertical movement of the locking plate 30 in a downward direction is prevented by the blocks 154 since the blocks 154 and the spacer-receiving openings 131 are displaced relative each other, i.e. the locking plate 30 is located on top of the blocks 154. As clearly shown in the magnified part of FIG. 9 a gap 48 is formed between the locking plate 30 and the lower sole 50. The spikes 21 are prevented from moving downwardly by the conical coil springs 140 and the spikes 21 are thus locked in a certain retracted position. Again, an important advantage of the invention compared to prior art is that the weight of the user is carried by the locking plate 30 and the spacing means 154, i.e. by a robust mechanical arrangement, when the shoe 2 is in its spike-retracted mode.

In FIG. 10 the locking plate 30 has been moved to its second position such that the spacing means 154 and the spacer-receiving openings 131 are aligned in such a way that the spacer-receiving opening 131 is capable of receiving the spacing means 154. The locking plate 30 is now free to move downwards and rest directly on the upper surface of the lower sole 50 eliminating the gap 48. The expanding forces of the springs 140, together with the forces of the bellows 52, keep the spikes 21, the locking plate 30 and the upper sole member 20 in an upper position. The gravitational forces of a shoe user 5 will however overcome the expanding forces resulting in that the upper sole member 20, the locking plate 30 and the spikes 21 move downwards, in turn resulting in that the spikes 21 will protrude below the lower sole 50 as shown in FIG. 10. In FIG. 10 the spikes 21 are exposed to a maximum. The length of the exposed portion of the spikes 21 depends e.g. on the surface the user are standing or walking on; if the surface is very hard, such as stone, the spikes 21 protrude only to a small extent, or may even be flush with the underside of the outer sole 50. The spikes 21 will be automatically retracted to an unlocked position as soon as the shoes 2 are lifted or taken off due to the forces of the coil springs 140 and the bellows 52 that push the lower sole 50 away from the locking plate 30 and push the locking plate 30 into an upper unlocked position. To lock the spikes 21 inside the sole arrangement 4 one thus only need to move the locking plate 30 to its first, locked position as shown in FIG. 9.

As discussed in connection to the first embodiment the arrangement of the spacing means 154 and the spacer-receiving openings 131, such as their shape and positions, may be varied also in the second embodiment.

The upper sole member 20 may be provided with steel plates (not shown) positioned above the spikes 21 to get a good upper support for the spikes 21. Such plates could also have a function of adapting the friction between the upper sole member 20 and the locking plate 30 such that the locking plate 30 becomes reasonably easy to move between its two positions. Also the upper surface of the spike cap 24, or the surface of the cap-receiving recesses 135, could be treated as to give a suitable friction. One example is to cover the cap 24 with a suitable material.

The vertical height of variation of the spikes 21 in the embodiments described above is given by the sum of the height of the spacing means, i.e. the rims 54 or the blocks 154, and the height/thickness of the locking sole member, i.e. the locking plate 30, minus the largest of these two measures. Preferably, the height/thickness of the locking sole member 30 and the spacing means 54, 154 are roughly similar as to keep the total height of the sole arrangement 4 as low as possible. In the examples described the vertical height of variation of the spikes 21 is 5 mm such that the spikes can be retracted 1 mm into the lower sole member 50 and be extended up to 4 mm below the lower sole member 50.

The spikes 21 could be made of steel, plastics, rubber or other suitable material or combinations of material. An example of a combination of material is to provide the tip of the spikes 21 with a sticky rubber for use on e.g. slippery indoor floors. In the first embodiment of the invention shown in FIGS. 1-6 the spikes 21 can be attached to the upper sole member 20 by various means such as glueing, welding, screwing and riveting. Alternatively, the spikes 21 can be integrated into the structure by e.g. molding them into a sole member. To get a good support for steel spikes one may use a flexible steel structure and attach the spikes 21 thereto by e.g. welding. Such a steel structure is preferably integrated in the upper sole member 20. However, such a steel structure may also form a separate unit and may be regarded as an upper sole member.

An advantage of having the spikes 21 unlocked in their extended mode is that also the lower, outer sole 30 is allowed to come in contact with the surface below the shoes. A combination of spike and outer sole contact gives an improved grip in certain situations, such as when the shoes are used on ice and snow. Another advantage is that dirt, ice and snow do not accumulate on the spikes 21 since they frequently get cleaned when moving between their retracted and extended positions.

The bellows 52 preferably form a part of the lower sole 50 and are preferably attached to the upper sole member 20 by adhesive means. A main function of the bellows 52 is to connect the upper and lower sole members 20, 50 in such a way that the lower sole 50 is allowed to move in a vertical direction relative to the upper sole 20, and thus relative to the spikes 21. Another main function is to prevent dirt from entering the sole arrangement 4. Preferably, the bellows 52 are arranged as to exhibit resilient properties which can be used as a complement to the conical coil springs 40, 140.

The invention is not limited by the embodiments described above but can be modified in various ways within the scope of the claims. For instance, the keyhole-shaped openings 31 could be turned in the opposite direction resulting in that the spikes 21 are locked within the shoe when the locking plate 30 is in its rear position instead of its forward position. To release the spikes 21 one would in such a case press the rear actuator 33. In another variant of the invention the locking plate 30 could be movable in a lateral or diagonal direction instead of the longitudinal direction described above. In such a case the keyhole-shaped openings 31 should of course be placed as to correspond to the direction of the movement of the locking plate 30.

As an alternative to the bellows 52 connecting the upper and lower sole members 20, it is possible to use expandable rubber or textile material. This sole connecting means could be an integral part of either the upper or the lower sole member 20, 50 or it could be a separate part. It is an advantage if the sole connecting means is arranged to limit the maximum distance between the upper and lower sole members 20, 50 for instance by containing non-flexible fibres arranged in a vertical direction.

As an alternative to the actuators 33, 33' the locking plate 30 may be connected to other external devices, such as a handle, for allowing manual external operation of the locking plate 30. Another example is to use a mechanical two-way button system involving spring lockings. This way one may eliminate one of the actuators 33, 33', preferably the front actuator 33 as to avoid any protruding parts at the toe-part of the shoe. It is also possible to use more sophisticated actuators for automated operation of the locking plate 30. One example is to use a battery-powered electric engine connected to the locking plate 30 via a gear tooth system.

Of course, the upper 20, locking 30 and lower 50 sole members may have a different design compared to what is described above. For instance, the sole members could be constituted of more than one unit and the sole arrangement 4 could comprise additional parts. One example is that the upper sole member 20 and the upper part 10 of the shoe could be integrated as to form one single unit. Such an integrated unit can be regarded as "the upper sole member".

It is possible to combine the first and second embodiment such that some of the spikes 21 are attached to the upper sole member 20 whereas some spikes 21 are arranged between the lower sole member 50 and the locking sole member 30.

As an alternative to the upper circular part 44 of the connecting member 41 and the openings (not shown) in the lower surface of the upper sole member 20 one could use guiding pins 23 as described in connection to the second embodiment and let them fit into an opening on the upper side of the connecting member 41.

The invention claimed is:

1. A sole arrangement, comprising:

an upper sole member and a lower sole member, wherein the lower sole member is positioned closer to the ground during normal use of the sole arrangement, said lower sole member being movably attached to the upper sole member allowing the lower sole member to move in a vertical direction relative to the upper sole member, a plurality of vertically extending spikes arranged inside the sole arrangement such that the spikes are moveable relative to the lower sole member, said lower sole member having a plurality of holes adapted to receive the spikes as to allow the spikes to protrude from the lower sole member in a downward direction, a locking sole member located between the upper and lower sole members, a spacer extending vertically from one of said sole members, and an opening arranged on one of the other of said sole members, said opening being adapted to receive the spacer, said spacer and spacer-receiving opening being arranged to face each other as to allow interaction between the two sole members equipped with the spacer and the spacer-receiving opening, respectively, said locking sole member being movably arranged as to allow a relative movement between the spacer and the spacer-receiving opening in a substantially horizontal direction, said locking sole member being adapted to be moved between:

a first position wherein the spacer and the spacer-receiving opening are at least partly displaced such that the spacer defines a minimum distance between the two interacting sole members, and a second position wherein the spacer and the spacer-receiving opening are aligned in such a way that the spacer-receiving opening is capable of receiving the spacer allowing the two interacting sole members to come closer to each other than the minimum distance.

2. The sole arrangement according to claim 1, wherein the lower sole member is attached to the upper sole member via a sole connector that surrounds the sole arrangement.

3. The sole arrangement according to claim 1, wherein the spacer is located between the locking sole member and the lower sole member.

4. The sole arrangement according to claim 3, wherein the spacer is associated with the lower sole member and the spacer-receiving opening is associated with the locking sole member.

5. The sole arrangement according to claim 4, wherein the spacer forms an integral part of the lower sole member.

6. The sole arrangement according to claim 4, wherein the spacer constitutes a plurality of protrusions extending upwardly from the lower sole member.

7. The sole arrangement according to claim 4, wherein the spacer includes a plurality of rims around the spike-receiving holes.

8. The sole arrangement according to claim 4, wherein the locking sole member is provided with a hole forming said spacer-receiving opening.

9. The sole arrangement according to claim 8, wherein said hole also forms a spike-receiving opening.

10. The sole arrangement according to claim 9, wherein said hole has a general shape of a key-hole.

11. The sole arrangement according to claim 1, further comprising an extender located between the two interacting sole members, said extender being capable of exerting a force between the two interacting sole members as to allow a variation of their relative distance.

12. The sole arrangement according to claim 11, wherein the extender is arranged between the lower sole member and the locking sole member.

13. The sole arrangement according to claim 11, wherein the extender comprises a coil spring.

14. The sole arrangement according to claim 13, wherein the coil spring is arranged around one of the spikes.

15. The sole arrangement according to claim 14, wherein the spike is provided with a cap located above the coil spring, said spike being arranged between the locking sole member and the lower sole member such that the coil spring presses the spike upwardly towards the locking sole member.

16. The sole arrangement according to claim 15, wherein a coil spring is arranged around each spike, each spike is provided with a cap located above the respective coil spring and each spike is arranged between the locking sole member and the lower sole member such that each spike is pressed upwardly towards the locking sole member by the respective coil spring.

17. The sole arrangement according to claim 13, wherein the coil spring has a conical shape.

18. The sole arrangement according to claim 15, wherein the locking sole member has a recess for receiving the spike cap.

19. The sole arrangement according to claim 1, wherein the spikes are attached to the upper sole member.

20. The sole arrangement according to claim 1, wherein at least one actuating member is connected to the locking sole member allowing operation of the locking sole member between the first and second positions.

21. The sole arrangement according to claim 20, wherein the at least one actuating member protrudes from the sole arrangement allowing external, manual operation of the locking sole member.

22. A shoe, comprising an upper and a sole arrangement, wherein the sole arrangement comprises:

an upper sole member and a lower sole member, wherein the lower sole member is positioned closer to the ground during normal use of the sole arrangement, said lower sole member being movably attached to the upper sole member allowing the lower sole member to move in a vertical direction relative to the upper sole member, a plurality of vertically extending spikes arranged inside the sole arrangement such that the spikes are moveable relative to the lower sole member, said lower sole member having a plurality of holes adapted to receive the spikes as to allow the spikes to protrude from the lower sole member in a downward direction, a locking sole member located between the upper and lower sole members, a spacer extending vertically from one of said sole members, and an opening arranged on one of the other of said sole members, said opening being adapted to receive the spacer, said spacer and spacer-receiving opening being arranged to face each other as to allow interaction between the two sole members equipped with the spacer and the spacer-receiving opening, respectively, said locking sole member being movably arranged as to allow a relative movement between the spacer and the spacer-receiving opening in a substantially horizontal direction, said locking sole member being adapted to be moved between:

a first position wherein the spacer and the spacer-receiving opening are at least partly displaced such that the spacer defines a minimum distance between the two interacting sole members, and a second position wherein the spacer and the spacer-receiving opening are aligned in such a way that the spacer-receiving opening is capable of receiving the spacer allowing the two interacting sole members to come closer to each other than the minimum distance.

* * * * *